United States Patent [19]

Hirayama

[11] 4,327,348

[45] Apr. 27, 1982

[54] VARIABLE LEAKAGE TRANSFORMER

[75] Inventor: Hiromitsu Hirayama, Funabashi, Japan

[73] Assignee: TDK Electronics Co., Ltd., Tokyo, Japan

[21] Appl. No.: 81,339

[22] Filed: Oct. 3, 1979

Related U.S. Application Data

[63] Continuation-in-part of Ser. No. 884,953, Mar. 9, 1978, Pat. No. 4,213,084.

[30] Foreign Application Priority Data

Oct. 14, 1978 [JP] Japan ..... 53-140209[U]
Oct. 14, 1978 [JP] Japan ..... 53-140210[U]

[51] Int. Cl.[3] ..... H01F 29/00

[52] U.S. Cl. ..... 336/184; 323/250; 323/254; 336/215

[58] Field of Search ..... 323/48, 56, 249, 250, 323/254, 262, 329, 331, 338, 339; 336/160, 165, 178, 184, 212, 215

[56] References Cited

U.S. PATENT DOCUMENTS

| | | | |
|---|---|---|---|
| 1,376,978 | 5/1921 | Stoekle | 323/56 |
| 2,281,593 | 5/1942 | Odessey | 323/56 |
| 2,383,460 | 8/1945 | Purves et al. | 336/120 X |
| 2,870,397 | 1/1959 | Kelley | 323/56 |
| 2,975,358 | 3/1961 | Ashman et al. | 336/120 X |
| 2,989,686 | 6/1961 | Pinckaers et al. | 323/56 |
| 3,087,108 | 4/1963 | Toffolo et al. | 323/56 |
| 3,183,429 | 5/1965 | Baycura et al. | 323/56 X |
| 3,185,917 | 5/1965 | Owen | 323/48 X |
| 3,188,552 | 6/1965 | Owen | 323/56 X |
| 3,231,841 | 1/1966 | Ohtake | 336/178 X |

*Primary Examiner*—A. D. Pellinen
*Attorney, Agent, or Firm*—Burgess, Ryan and Wayne

[57] ABSTRACT

A variable leakage transformer or a variable voltage transformer comprising a magnetic core with a main-magnetic path and a sub-magnetic path, the main magnetic path having at least a common magnetic path with the submagnetic path, a primary winding wound on said common magnetic path of the core, a secondary winding wound on said main magnetic path of the core, means for controlling the magnetic flux in said sub-magnetic path, and said main-magnetic path having a thin air gap. By controlling the magnetic flux in the sub-magnetic path, the leakage of the flux induced by the primary winding from the main-magnetic path to the sub-magnetic path can be controlled. Thus the coupling between the primary and secondary windings, and conduction period in each cycle of the AC output voltage are controlled. The control of the conduction period in each cycle provides the control of the power transmitted from the primary winding to the secondary winding. Because of the presence of the air gap provided in the main-magnetic path, excellent control of the output voltage is obtained even when a load is small.

6 Claims, 14 Drawing Figures

VARIABLE LEAKAGE TRANSFORMER

This application is a continuation-in-part of copending application Ser. No. 884,953, filed Mar. 9, 1978 (now issued as U.S. Pat. No. 4,213,084) and assigned to the assignee of the instant application.

BACKGROUND OF THE INVENTION

The present invention is concerned with the structure and application of a variable leakage transformer or a variable voltage transformer.

A transformer has, in general, a magnetic core having a closed magnetic path, a primary and secondary winding wound on said magnetic core, and all the input power applied to the primary winding is provided at the output of the secondary winding except for a small amount of loss in the transformer. In this case, the output voltage $V_2$ across the secondary winding is $$V_2=(n_2/n_1)\times V_1,$$

where $V_1$ is the voltage across the primary winding and $n_1$ and $n_2$ are the number of windings of the primary and secondary windings, respectively.

When we want to control the output power of the transformer, a controllable switching device such as a SCR (Silicon Controlled Rectifier) or a transistor must be employed at the output of the transformer. In said controllable switching device, the pulse width during each cycle is varied by controlling the conducting time of the switching element (SCR). However, a prior controllable switching device has the disadvantage that the circuit is very complicated and the price of the device is rather high.

Another prior art device for controlling an AC power source is a magnetic amplifier, in which a saturable reactor is inserted between the power source and the load, and by controlling the reactor, the power transferred from the source to the load is controlled. However, a magnetic amplifier has the disadvantage that the voltage across the load must be the same as that of the power source, and the saturable reactor does not function as a variable-voltage transformer.

SUMMARY OF THE INVENTION

It is an object of the present invention, therefore, to overcome the disadvantages and limitations of a prior transformer by providing a new and improved controllable transformer which operates on the principle of leakage flux control.

It is also an object of the present invention to provide a new and improved stabilized power source using the present transformer.

The above and other objects are attained by a variable leakage transformer comprising a magnetic core with a main magnetic path and a sub-magnetic path, the main magnetic path having at least a common magnetic path with the sub-magnetic path, a primary winding wound on said common magnetic path, a secondary winding wound on said main magnetic path, means for controlling the magnetic flux in said sub-magnetic path, and a thin air gap provided in said main-magnetic path.

Preferably, the magnetic flux in said sub-magnetic path is controlled by the direct current in the control winding wound on said sub-magnetic path.

BRIEF DESCRIPTION OF THE DRAWINGS

The foregoing and other objects, features, and attendant advantages of the present invention will be appreciated as the same become better understood by means of the following description and accompanying drawings wherein;

FIG. 9 is the structure of another embodiment of the present transformer, and relates to the equivalent circuit in FIG. 7; while

DESCRIPTION OF THE PREFERRED EMBODIMENTS

Figure 1:
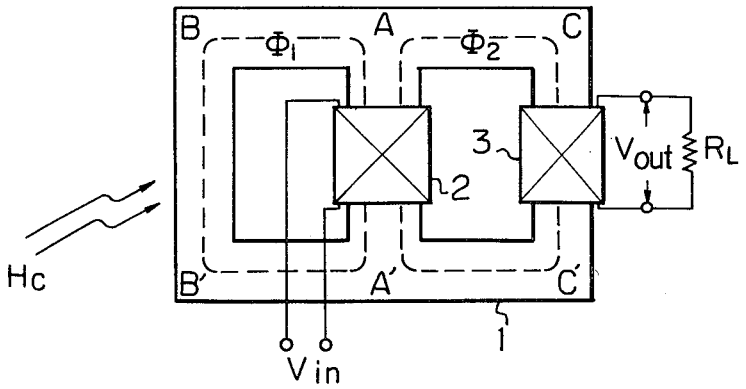
FIG. 1 is the cross sectional view of the present transformer.

FIG. 1 shows the first embodiment, depicting a configuration based on the principle of this invention. In this figure, the magnetic core 1, composed of the combination of either the E shaped core and I shaped cores or a pair of E shaped magnetic cores, is a three legged magnetic core having 2 magnetic paths, a sub-magnetic path AA'B'B and a main magnetic path AA'C'C. The middle leg AA' and the side leg CC' of the magnetic core 1 are provided with the primary coil 2 and secondary coil 3, respectively. The number of turns of the primary coil 2 is assumed to be $N_1$ and that of the secondary coil $N_2$.

Now, the load resistor $R_L$ is connected to the secondary coil 3 and AC (Alternate Current) input voltage $B_{in}$ is applied to the primary coil 2. The magnetic flux $\phi$ generated thereby is divided into the magnetic flux $\phi_1$ that surrounds the sub-magnetic path AA'B'B, and the magnetic flux $\phi_2$ that surrounds the main magnetic path AA'C'C. That is, the formula $\phi=\phi_1+\phi_2$ is satisfied. Of these two fluxes, the one that supplies power to the load resistor $R_L$ is the one that interlinks with the secondary coil 3, i.e. $\phi_2$. The $\phi_1$ does not contribute the power supply to the load resistor $R_L$. At this stage, if the magnetic reluctance is increased by application of the control magnetic field $H_c$ to the sub-magnetic path AA'B'B from outside, the magnetic flux $\phi_1$ decreases with resultant proportionate increases in the magnetic flux $\phi_2$. Therefore, the output voltage $V_{out}$ of the secondary coil 3, i.e. the power supplied to the load resistor $R_L$, increases. Eventually, it can be seen that power transferred from the primary to the secondary can be controlled by changing the strength of the magnetic field through application of the control magnetic field $H_c$ to the sub-magnetic path AA'B'B from outside.

Said control magnetic field $H_c$ can be obtained, for instance, through a winding wound on the sub-magnetic path, for instance on the leg BB', and by controlling the D.C. current in said winding, the strength of magnetic field $H_c$ is controlled.

Figure 2:
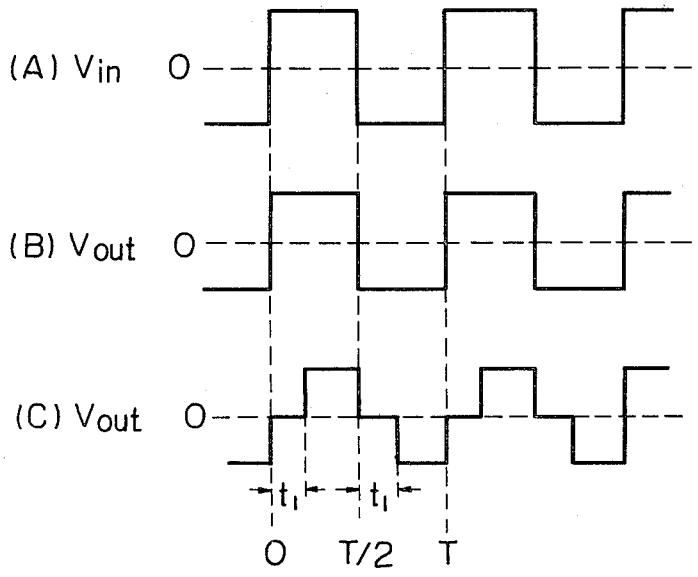
FIG. 2(A), FIG. 2(B) and FIG. 2(C) show the principle operational waveforms of the transformer in FIG. 1, FIG. 3(A) and FIG. 3(B) show the actual operational waveforms of the transformer in FIG. 1.

Suppose that a rectangular wave voltage is applied to the primary coil 2, as input voltage $V_{in}$ such as given in FIG. 2(A), if the sub-magnetic path AA'B'B is in a perfectly saturated condition in the control magnetic field $H_c$ because this sub-magnetic path is considered to be equivalent to non-existent as a magnetic circuit, the output wave form of the output voltage $V_{out}$ thus obtained is identical with that of the input voltage $V_{in}$ shown in FIG. 2(B). The amplitude is determined by the ratio between the number of turns $N_1$ on the primary coil 2 and the number of turns $N_2$ on the secondary coil 3. That is, $V_{out}=V_{in}(N_2/N_1)$.

Suppose that the sub-magnetic path AA'B'B is put in a non-saturated condition by weakening the control magnetic field $H_c$, some of the magnetic flux $\phi$ generated by input voltage $V_{in}$ flows to the sub-magnetic path during the time $t_1$ i.e. from the time the input voltage $V_{in}$ is applied until the time the sub-magnetic path AA'B'B is saturated by the input voltage $V_{in}$. Then, the output voltage $V_{out}$ in effect becomes almost zero.

After a period of time $t_1$, the sub-magnetic path AA'B'B becomes saturated. This saturated condition is maintained until inversion of the input voltage $V_{in}$. Therefore, as given in FIG. 2(C) the output voltage $V_{out}$ $(=V_{in}N_2/N_1)$ appears only during the time $(T/2-t_1)$. At this stage, the length of time $t_1$ can be changed by changing the magnetized condition of the sub-magnetic path AA'B'B, or in other words by the magnitude of the control magnetic field $H_c$ applied to the sub-magnetic path AA'B'B.

Thus, by increasing or decreasing the magnitude of the control magnetic field $H_c$, the pulse width of output voltage $V_{out}$ can be controlled. During the time $t_1$, power consumption in the primary winding is zero, because the magnetic flux $\phi$ surrounds the sub-magnetic path AA'B'B and does not interlink with the secondary coil 3, and therefore, the load as viewed from the primary coil 2 is in a condition equivalent to an open circuit. In other words, the control does not affect power efficiency while the operation is always highly efficient.

Performance of this first embodiment shows that the pulse width of the output voltage $V_{out}$ can be efficiently controlled by increasing or decreasing the magnitude of the control magnetic field $H_c$.

It should be appreciated of course that an input voltage of sinusoidal waveform is also applicable and provides the same effect as a rectangular waveform, although the embodiment shows the rectangular waveform for the sake of simplicity of the explanation.

As explained above, according to the present invention, the leakage of the magnetic flux from the main magnetic path to the sub-magnetic path can be controlled by varying the magnetic flux in the sub-magnetic path, and thus, the coupling between the primary and secondary windings and the conduction period in each cycle of the input voltage are controlled. And it should be noted that the control of the conduction period provides the control of the power transmission from the primary winding to the secondary winding.

Figure 3:
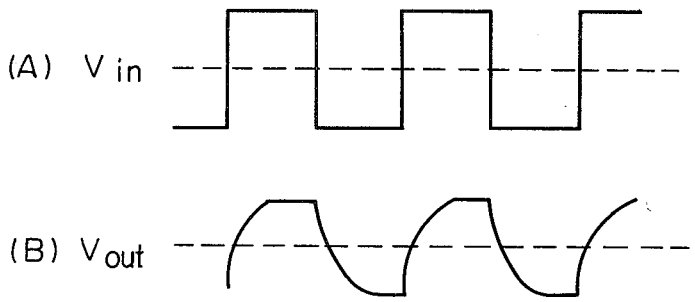

In the above embodiment, the primary coil 2 was wound around the middle leg of the magnetic core 1 and the secondary coil 3 was wound around one of the side legs. As a result of this arrangement, the magnetic coupling between the primary coil 2 and the secondary coil 3 has a tendency to be insufficient. If the coupling is insufficient, even if the rectangular wave input voltage $V_{in}$ as given in FIG. 3(A) is applied, the wave form of the output voltage $V_{out}$ becomes deformed as shown in FIG. 3(B), and the efficiency of the transformer is decreased. This results from insufficient coupling between the primary coil 2 and the secondary coil 3.

Figure 4:
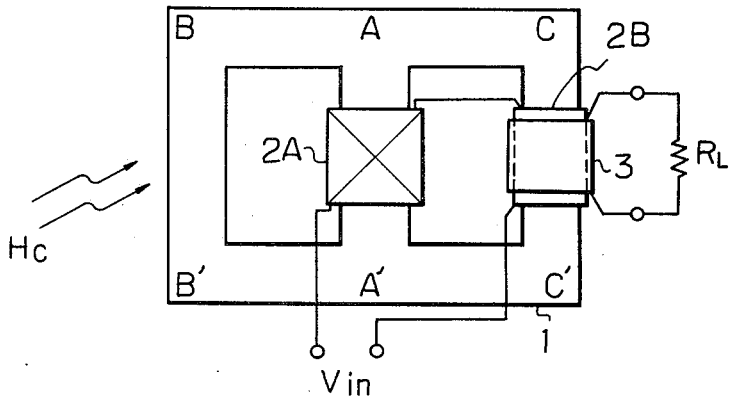
FIG. 4 is the cross sectional view of another embodiment of the present transformer.

FIG. 4 depicts the second embodiment which provides a configuration with improvements on the above mentioned drawback. In this Figure, the primary coil is divided into the first primary coil 2A and the second primary coil 2B. The first primary coil 2A surrounds the middle leg AA' of the magnetic core 1 and the second primary coil 2B surrounds the side leg CC'. The secondary coil 3 is also wound over the second primary coil 2B. With this arrangement, the coupling between the primary and the secondary coils becomes sufficient and the wave form of the output voltage $V_{out}$ and that of the input voltage $V_{in}$ can be made almost identical.

The configuration in FIG. 4 with the divided primary windings is advantageous in particular when the magnetic core constituting the main magnetic path and the sub-magnetic path is ferrite, whose magnetic permeability is rather small. When the magnetic permeability of the core is small, the coupling between the primary winding and the secondary winding is insufficient, and the output waveform is deformed. This insufficiency is overcome by dividing the primary winding into the first primary winding and the second primary winding, one of which is closely coupled with the secondary winding, as shown in FIG. 4. Since a ferrite core is excellent in a high frequency operation, the transformer utilizing a ferrite core operating in high frequency can be constituted in a small size.

According to one embodiment of the present invention, a ferrite core with the magnetic permeability being approximate 300~1000 is utilized, the frequency of the input signal is in the range 20~30 $kH_z$, and 50 percent of turns of the primary winding is divided to the second primary winding.

The preferable ferrite core is obtained in the commercial market as the tradename H7C1 manufactured by TDK Electronics, Co., Ltd., Tokyo, Japan, the magnetic permiability of said H7C1 is approximate 5,000 in a ring shaped core, and is approximate 300~1000 in an assembled E and I cores. The permiability in an assembled E and I cores is considerably decreased compared with that of a ring shaped core, because of the inevitable air gap at the coupling portion between an E shaped core and an I shaped core.

Figure 5:
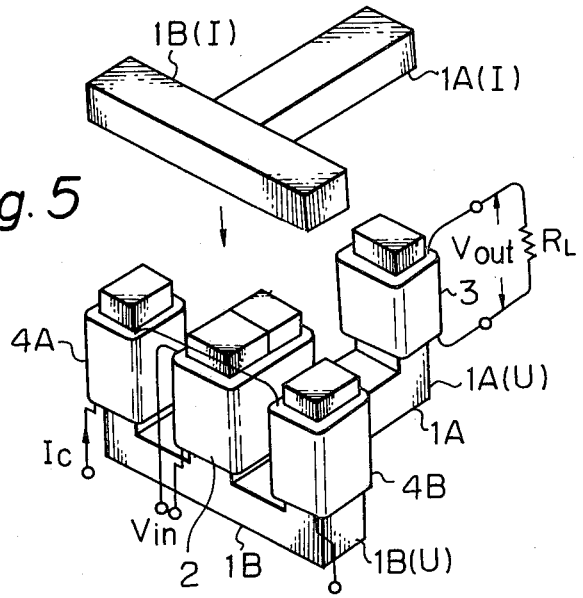
FIG. 5 is the perspective view of still another embodiment of the present transformer.

FIG. 5 illustrates another embodiment. In FIG. 5, the magnetic core 1A forming the main magnetic path is made up of the combination of the U shaped core 1A(U) and the I shaped core 1A(I), and the magnetic core 1B forming the submagnetic path is made up of the combination of the E shaped core 1B(E) and the I shaped core 1B(I). And, the primary coil 2 is wound in common around one of the legs of the magnetic core 1A and the middle leg of the magnetic core 1B while the secondary coil 3 is wound around the other leg of the magnetic core 1A. Both the side legs of the magnetic core 1B are provided with the control coils 4A and 4B. The control coils 4A and 4B are connected in series so that the voltages induced in these coils will cancel each other when the input voltage $V_{in}$ is applied to the primary coil 2.

According to the above arrangement, the magnetized condition of the magnetic core 1B forming the sub-magnetic path can be changed by the control current $I_c$ fed to the control coils 4A and 4B. That is, when the rectangular wave such as shown in FIG. 2(A) is applied as input voltage $V_{in}$, the magnetization strength of the sub-magnetic path becomes large if control current $I_c$ is large, while the time $t_1$ in FIG. 2(C) becomes short. If the control current $I_c$ is small, the strength of magnetization of the sub-magnetic path becomes weak while the time $t_1$ becomes long. As a result, pulse width of output voltage $V_{out}$ can be controlled.

In the embodiment in FIG. 5 the magnetic core is made up of the EI magnetic core and the UI magnetic core combined. However, it should be appreciated that a magnetic core having the same effect may be formed by a combination of the four-legged magnetic core IC and the T shape magnetic core ID as depicted in FIG. 6.

Figure 6:
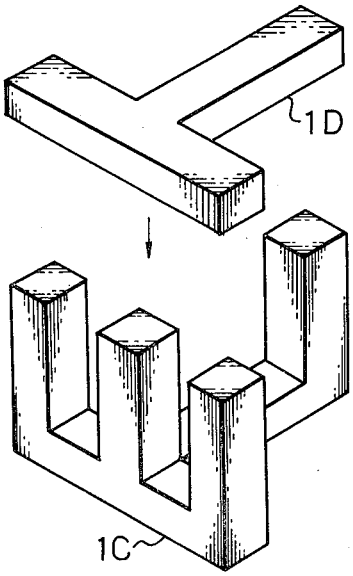
FIG. 6 shows the other structure of the core for the use of the transformer in FIG. 5.

Although FIG. 5 disclosed the embodiment using U-I core and E-I core, it should be appreciated of course that many modifications of FIG. 6, for instance the embodiment using U-U core and E-E core, are possible.

In the embodiment shown in FIG. 5, the wave form of output voltage $V_{out}$ can be improved by dividing the primary coil 2 as demonstrated in the second embodiment in FIG. 4 and by closely coupling a part of the primary coil to the secondary coil 3.

The characteristics of the present transformer is improved by providing a narrow air gap in the main magnetic path. This air gap improves the characteristics of the transformer when the load of the transformer is small, this is to say, when the load is small, the magnetic reluctance of the main magnetic path is inherently small, and so the presence of the sub-magnetic path does not greatly affect the magnetic flux in the main magnetic path, and thus, the output voltage on the secondary winding can not be controlled when the load is small. The improvement for overcoming this problem is described in accordance with FIGS. 7 through 10.

Figure 7:
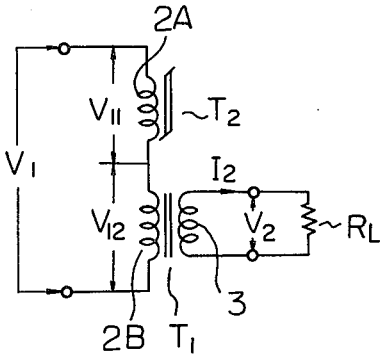
FIG. 7 shows the equivalent circuit of another embodiment of the present transformer.

FIG. 7 shows the equivalent circuit of the present transformer, in which an ordinary transformer $T_1$ having the primary winding 2B and the secondary winding 3 coupled closely with the primary winding 2B, and the saturable reactor $T_2$ having the winding 2A connected in series with the primary winding 2B are provided. Assuming that the inductance of the saturable reactor $T_2$ is $L_1$, and the inductance of the primary winding 2B of the transformer $T_1$ is $L_2$, the voltages $V_{11}$ and $V_{12}$ across the reactor winding 2A and the primary winding 2B respectively are proportional to the inductances $L_1$ and $L_2$ respectively, and are shown below.

$$V_{11} = \frac{L_1}{L_1 + L_2} V_1, \quad V_{12} = \frac{L_2}{L_1 + L_2} V_1$$

It should be noted that the inductance $L_1$ of the saturable reactor becomes small when the control current in the windings 4A and 4B in FIG. 5 is large, and then the voltage $V_{11}$ is small and the voltage $V_{12}$ is large and the output voltage is large. When the control current is small, the inductance $L_1$ is large, the voltage $V_{11}$ is large, the voltage $V_{12}$ is small and the output voltage is small.

Figure 8:
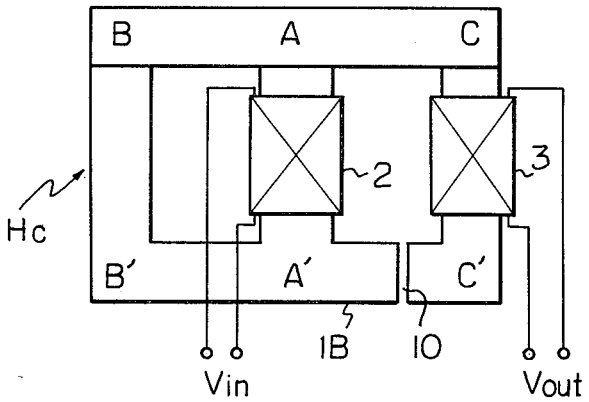
FIG. 8 shows the structure of another embodiment of the present transformer, and relates to the equivalent circuit in FIG. 7.

FIG. 8 shows the improvement of FIG. 1, and the feature of FIG. 8 is the presence of a narrow air gap 10 in the main magnetic path. The presence of the air gap 10 increases the magnetic reluctance of the main magnetic path and so the output voltage can be controlled even when the load is small.

Figure 9:
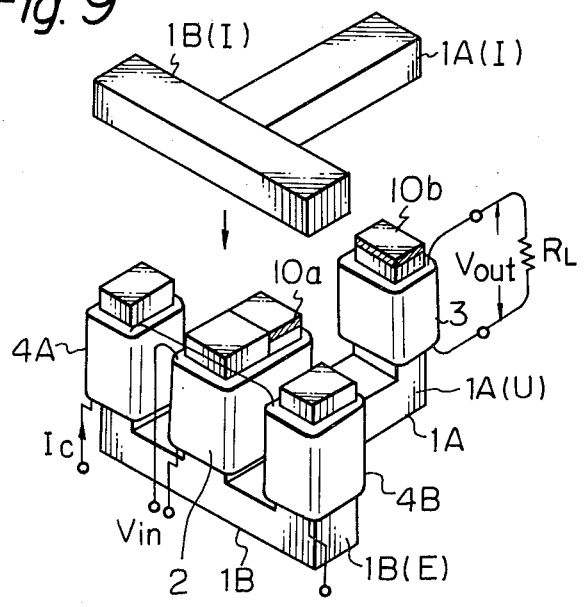

FIG. 9 is the improvement of the structure of FIG. 5, and the feature of FIG. 9 is the presence of the spacers **10*a* and 10*b* of non-magnetic material like copper at the top of the U shaped core 1A(U). The thickness of the spacers is preferably 100~150 μm. Due to the presence of those spacers, the magnetic reluctance in the main magnetic path is increased and the same effect as that in FIG. 8** is obtained.

Figure 10:
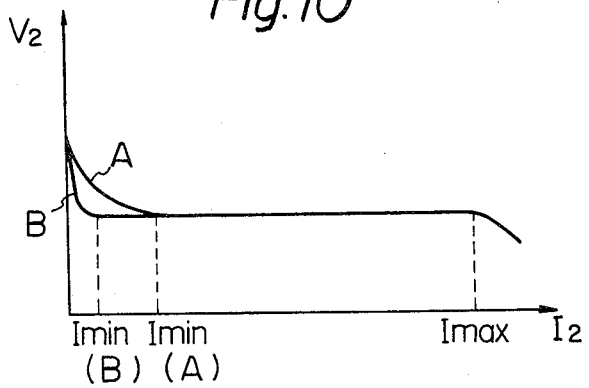
FIG. 10 shows the characteristics of the transformer shown in FIG. 8 or FIG. 9.

FIG. 10 shows the effect of the air gap or a spacer in the main magnetic path, and in FIG. 10 the horizontal axis shows the output current ($I_2$) (logarithmic scale) which corresponds to the load, and the vertical axis shows the output voltage ($V_2$). The curve (A) shows the characteristics when no air gap nor spacers is provided, and the curve (B) shows the characteristics when an air gap or spacers of non-magnetic material is provided when the control current is constant. It should be appreciated in FIG. 10 that the presence of an air gap or spacers improves the characteristics for a small load, and the deviation of the output voltage of the transformer is decreased by the presence of an air gap or spacers. In FIG. 10, the curve (A) shows that the output voltage ($V_2$) is constant for the range from $I_{min}$(A) to $I_{max}$ of the output current ($I_2$), and the curve (B) shows that the output voltage ($V_2$) is constant for the range from $I_{min}$(B) to $I_{max}$ of the output current ($I_2$). Apparently, $I_{min}$(B) is smaller than $I_{min}$(A), and so the substantial operational range of the curve (B) is wider than that of the curve (A).

Figure 11:
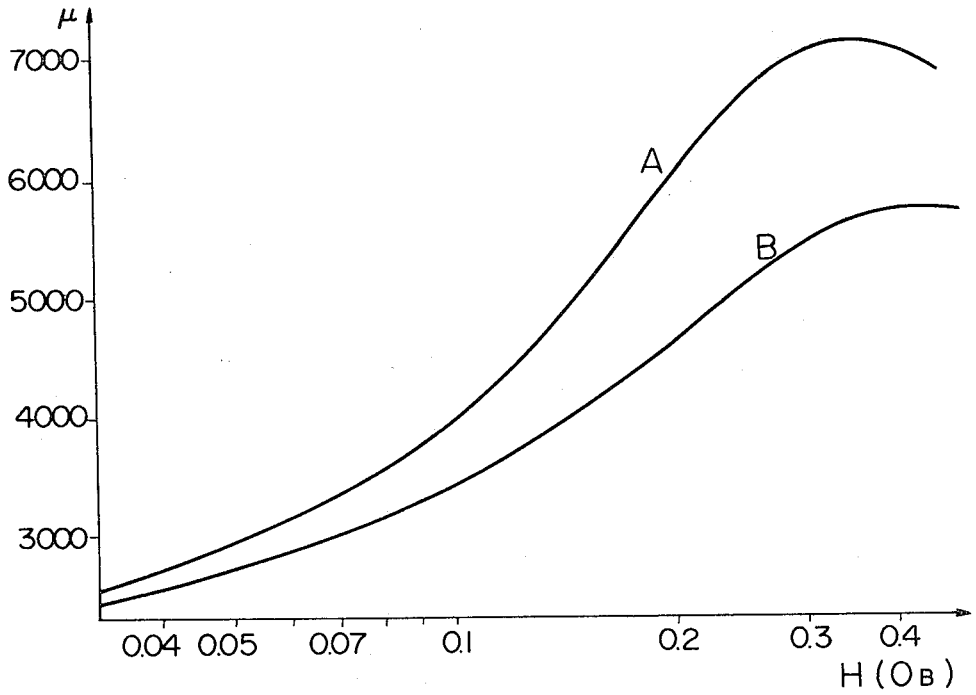
FIG. 11 shows the characteristics of the core utilized in the still another embodiment of the present transformer.
Figure 12A:
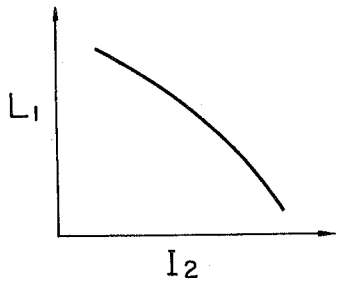
FIG. 12(A) and FIG. 12(B) show the characteristics of the transformer which utilizes the core shown in FIG. 11.
Figure 12B:
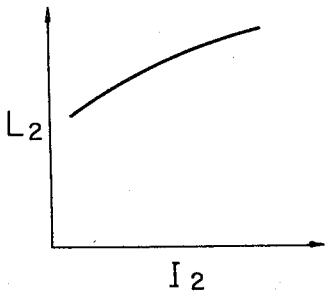

FIG. 11, shows the replacement of said air gap or spacers. FIG. 11 shows the characteristics of the magnetic permiability (μ) of the core utilized in the main magnetic path and/or the sub-magnetic path. The curve (A) in FIG. 11 shows the H-μ characteristics of XO13 type manganese-zinc ferrite material manufactured by TDK Electronics Co., Ltd., in Tokyo, Japan, and the curve (B) in FIG. 11 shows the characteristics of H7C1 type ferrite material. In FIG. 11, the horizontal axis shows the magnetic flux (H;oersted) in the core, and the vertical axis shows the magnetic permiability (μ), and it should be appreciated from FIG. 11 that the material of the curve (A) is preferable than the material of the curve (B), since the ratio of the permiability when the magnetic flux is large to that when the magnetic flux is small, is larger for the material (A). Actually, the material (A) shows that the permiability for H=0.35 oersted is 7,100 and the permiability for H=0.04 oersted is 2,700, so the ratio is 7,100/2,700=14,000, while the material (B) shows that the permiability for H=0.35 oersted is 5,600 and the permiability for H=0.04 oersted is 2,550, so the ratio is 5,600/2,550=9,800. Preferably, the value of that ratio is larger than 10,000 for the purpose of the present invention. Some experimental conditions for the curves of FIG. 11 are that a sample core is a toroidal shape with the inner diameter 19 mm, the frequency is 25 KHz and the temperature is 25° C. That characteristic, in particular the characteristic of the curve A is equivalent to the air gap or spacers. When the core of the characteristics of the curve (A) in FIG. 11 is utilized, the characteristics of the inductances $L_1$ and $L_2$ of the windings 2A and 2B respectively for the change of the load current ($I_2$) are shown in FIG. 12(A) and 12(B) respectively. It should be noted from FIGS. 12(A) and 12(B) that the inductance $L_1$ is comparatively large when the load current ($I_2$) is small, and the output voltage of the transformer is well controlled even when the load is small.

It should be appreciated that the combination of the above features mentioned in FIG. 4, which is the division of the primary winding when a ferrite core is utilized, FIG. 8 or FIG. 9 which shows the presence of the air gap or spacers, and/or FIGS. 11 through 12(B) will provide the more improved transformer.

Figure 9A:
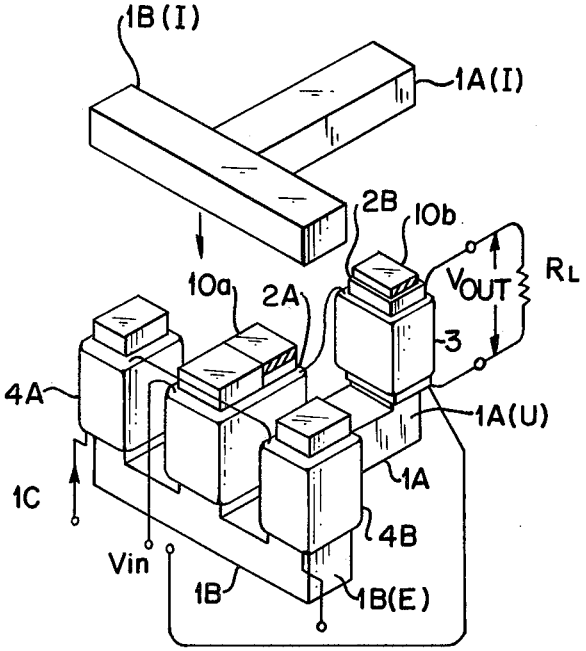
FIG. 9A shows a modification thereof having a primary winding structure similar to that of FIG. 4.

FIG. 9A shows the modification of the structure of FIG. 9. In FIG. 9A, the primary winding 2 is separated into two portions 2A and 2B, similar to the primary winding arrangement shown in FIG. 4. The portion 2A is wound on the common magnetic path, and the portion 2B is wound on the main magnetic path with close magnetic coupling to the secondary winding. The separated arrangement of the primary winding provides an improvement of the output waveform.

What we claimed is:

1. A variable leakage transformer comprising of a first closed magnetic path having a U shaped core and an I shaped core, a second closed magnetic path having an E shaped core and an I shaped core, the center leg of said E shaped core being connected to one leg of said U shaped core, a pair of spacers of non-magnetic material inserted between the top of the legs of said U shaped core and the related I shaped core, said U shaped core and the relating I shaped core constituting the main magnetic path and said E shaped core and the relating I shaped core constituting the sub-magnetic core, a primary winding wound common to the center leg of said E shaped core and one leg of said U shaped core, a secondary winding wound on the other leg of said U shaped core, and a pair of control windings wound on the pair of side legs of said E shaped core and being connected in series with each other.

2. A variable leakage transformer according to claim 1, wherein said cores are made of ferrite, and at least a part of said primary winding is wound on the same leg of said U shaped core as that on which the secondary winding is provided.

3. A variable leakage transformer, comprising:

(a) a closed main magnetic path made of ferromagnetic material;

(b) a pair of closed sub-magnetic paths made of ferromagnetic material having a common portion;

(c) said common portion of the sub-magnetic paths coinciding with a part of the main magnetic path to provide a common magnetic path;

(d) a primary winding wound on said common magnetic path;

(e) a secondary winding wound on said main magnetic path;

(f) a pair of control windings wound on respective ones of said sub-magnetic paths and connected in series with each other;

(g) said primary winding being divided into a first primary winding portion and a second primary winding portion, said first primary winding portion being wound on the common magnetic path, and said second primary winding portion being wound on the main magnetic path in closely coupled magnetic relationship with the secondary winding, (h) the sub-magnetic paths being symmetrically arranged with respect to the main magnetic path, and (i) a small magnetic gap being provided in the main magnetic path, and the sub-magnetic paths being completely closed without any magnetic gap therein.

4. A variable leakage transformer according to claim 3, wherein said gap comprises a spacer made of non-magnetic material.

5. A variable leakage transformer according to claim 3, wherein said ferromagnetic material has a characteristic such that the ratio of (i) the magnetic permeability thereof when the magnetic flux therein is high to (ii) the magnetic permeability thereof when the magnetic flux therein is low, is large.

6. A variable leakage transformer according to claim 3, wherein said ferromagnetic material comprises a ferrite.

* * * * *